United States Patent [19]

Zinga

[11] 4,127,143

[45] Nov. 28, 1978

[54] TANK DIFFUSER

[75] Inventor: William L. Zinga, Arlington Heights, Ill.

[73] Assignee: Zinga Industries Inc., Bellwood, Ill.

[21] Appl. No.: 788,311

[22] Filed: Apr. 18, 1977

[51] Int. Cl.[2] ..... B05D 17/00

[52] U.S. Cl. ..... 137/592

[58] Field of Search ..... 137/590, 592, 561 A; 239/556, 557, 568, 589, 601; 285/368

[56] References Cited

U.S. PATENT DOCUMENTS

| | | | |
|---|---|---|---|
| 504,739 | 9/1893 | Murray | 285/368 X |
| 553,709 | 1/1896 | Friedman | 137/592 X |
| 2,207,057 | 7/1940 | Gulick | 137/592 |
| 3,131,245 | 4/1964 | Lorenz | 285/368 X |
| 3,263,934 | 8/1966 | Hope, Jr. et al. | 239/601 X |
| 3,420,450 | 1/1969 | Bergholm | 239/601 |
| 3,993,094 | 11/1976 | Spoonel | 137/592 X |

*Primary Examiner*—William R. Cline

*Attorney, Agent, or Firm*—Wegner, Stellman, McCord, Wiles & Wood

[57] ABSTRACT

A diffuser for use in a liquid circulation system having a tank for holding a body of liquid. The diffuser is connected to the return flow passage and provides an improved delivery of the returning liquid to the tank effectively minimizing turbulent aeration of the liquid therein. The diffuser may comprise a one-piece element having a frustoconical wall portion connected at its narrow end to the return flow passage with the wide end directing the returning liquid into the body of liquid in the tank in a nonturbulent manner. The wide end of the frustoconical wall portion may be provided with a tubular flange for further controlling the delivery of liquid into the tank. The frustoconical wall may be provided with at least one longitudinal slot which may widen inwardly toward the wide end of the frustoconical wall to provide further improved control of the liquid delivery into the tank. The diffuser may be threadedly mounted to a suitable adapter provided in the tank wall, or flange mounted to the tank wall as desired.

13 Claims, 8 Drawing Figures

TANK DIFFUSER

BACKGROUND OF THE INVENTION

1. Field of the Invention

This invention relates to liquid flow systems and in particular to means for preventing foaming and the like in liquids being returned to a tank portion of the system.

2. Description of the Prior Art

In U.S. Letters Pat. No. 2,636,512 of Albert C. Smith, Jr., a flow directing baffle for reducing the turbulence of flow of fluid entering a space from a circuit is illustrated. The baffle is arranged to dissipate kinetic energy of the flowing fluid so that the turbulence is substantially eliminated. The apparatus permits initial turbulence and spray but confines the same within the walls and dome of the baffle cylinder. The air is permitted to escape through an aperture on top of the dome and subsequently the liquid is permitted to escape between the open end of the dome cylinder and a spaced fitting. The dome causes the direction of the fluid to be changed so as to reverse the flow and cause an outer portion of the flow to be counter to the center core of the incoming liquid flow. The patentee teaches that contact between the center core and the outward downwardly flowing portion of the fluid causes the energy to be dissipated.

Other prior devices for use in controlling delivery of fluids into a tank include that of George H. Gundlach U.S. Pat. No. 1,716,692 wherein a bulging sleeve is provided about the inner end of the delivery pipe with each of the sleeve and pipe end being longitudinally slit with the slits of the sleeve and pipe being offset so that the sleeve will function as a baffle.

Russell A. Gulick, in U.S. Pat. No. 2,207,057, provides stratification means in a hot water tank for impeding the mixture of incoming unheated water with hot water in the tank. Gulick teaches the use of perforated plates in the region of the inlet connection, and more specifically, shows the use of bowed perforated plates extending across the interior of a conical inlet device. Gulick teaches that, in the preferred form, three perforated baffles are arranged so as to cause the incoming water stream to be broken up to a plurality of small streams.

John F. Berninger, in U.S. Pat. No. 3,246,670, shows an air-oil tank utilizing a baffle returning the oil around the inlet conduit somewhat in the manner of the Smith, Jr. Pat. No. 2,636,512 discussed above.

Charles O. Burch, in U.S. Letters Pat. No. 3,638,676, shows an inlet distributor for storage tanks wherein the inlet conduit discharges into a small distributor tank which may utilize optional flow-directing baffles and which is provided with a perforated top wall.

In U.S. Pat. No. 3,682,197, David M. Snyder shows a reservoir assembly having an apertured diffuser in the lower portion of the tank in the form of a cup-shaped element having foraminous sidewalls.

Leon Levin, in U.S. Pat. No. 3,782,416, shows an apparatus for filling and emptying reservoirs wherein the end of the delivery duct opens vertically into a shaped diffusing opening covered by a deflector screen spaced from the shaped outlet.

SUMMARY OF THE INVENTION

The present invention comprehends an improved tank diffuser for use in a liquid circulation system having a tank for holding a body of liquid and means for circulating the liquid from the tank and through a return flow passage back into the tank.

The diffuser is connected to the return flow passage within the tank to provide diffused delivery of the returning liquid into the body of liquid in the tank to effectively minimize turbulent aeration of the liquid. Thus, the diffuser of the present invention is advantageously adapted for use in hydraulic systems wherein it is highly desirable to prevent foaming and aeration of the hydraulic oil.

In the illustrated embodiment, the diffuser includes a frustoconical wall portion having a connecting means at the narrow outer end thereof. The connecting means is adapted to be connected to a connector at the end of the return flow passage for delivering the returning liquid into the frustoconical interior space defined by the frustoconical wall whereby the cross-sectional area of the returning liquid stream in the frustoconical wall space gradually increases as the fluid returns into the body of liquid in the tank.

The frustoconical wall may be provided with at least one slot elongated in a direction parallel to the axis of the frustoconical wall, and in the illustrated embodiment, the slot enlarges toward the wide inner end of the frustoconical wall.

In the illustrated embodiment, a pair of such slots are provided at diametrically opposite portions of the frustoconical wall.

The slots may have a length a major portion of the length of the frustoconical wall.

The frustoconical wall may be provided at its inner wide end with an annular, generally tubular flange extending inwardly therefrom for further directing the incoming fluid flow. In the illustrated embodiment, the flange has a length of approximately 20 to 25 percent of the axial length of the frustoconical wall.

In the illustrated embodiment, the frustoconical wall widens inwardly at an angle of approximately 10° to 15° to the axis of the wall.

Further in the illustrated embodiment, the wide end of the frustoconical wall space is at least 50% larger than the narrow end thereof.

The diffuser may comprise a one-piece element and is extremely simple and economical of construction while yet providing the improved functioning discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
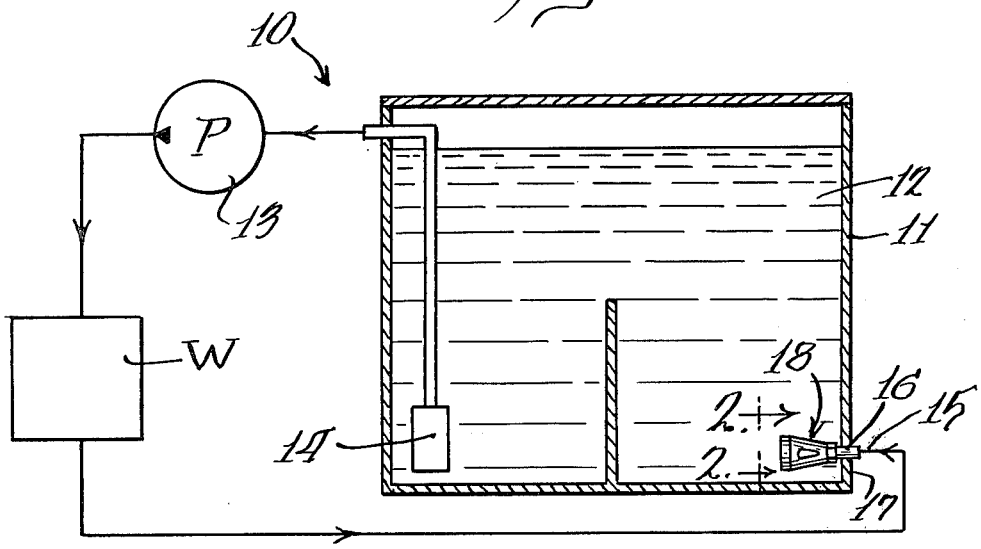
FIG. 1 is a schematic illustration of a liquid circulation system having a tank diffuser embodying the invention.

In the exemplary embodiment of the invention as disclosed in FIGS. 1–4 of the drawing, a liquid circulation system generally designated 10 is shown to include a holding tank 11 wherein a body of liquid, such as hydraulic oil, 12 is temporarily held for circulation in the system. Illustratively, the system may further include a pump 13 connected to an outlet 14 from the tank. The pump may deliver the hydraulic oil to a suitable work element W from which the oil may be returned to the tank through a return line defining a return flow passage 15.

In the illustrated embodiment, the return line is provided with an adapter connector 16 mounted in a lower portion 17 of the tank wall to conduct the returning liquid back into a lower portion of the liquid body 12 in the tank 11.

The present invention is concerned with delivering the incoming returning liquid into the liquid body 12 in such a manner as to effectively minimize turbulent aeration of the liquid for improved continued operation of the circulation system. To this end, a diffuser generally designated 18 is mounted to connector 16 to extend into the lower portion of the tank and provide a controlled diffused delivery of the returning liquid thereinto.

Figure 2:
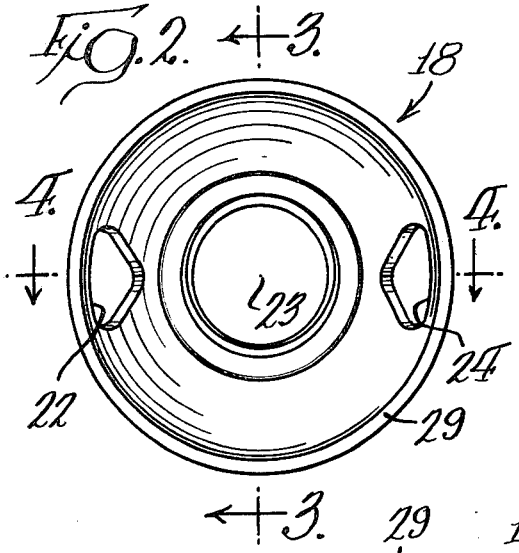
FIG. 2 is an inner end view of the diffuser.
Figure 3:
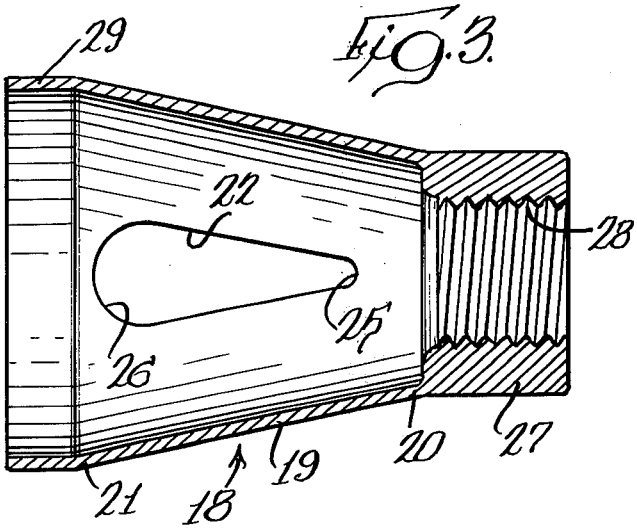
FIG. 3 is a diametric section of the diffuser taken substantially along the line 3—3 of FIG. 2.
Figure 4:
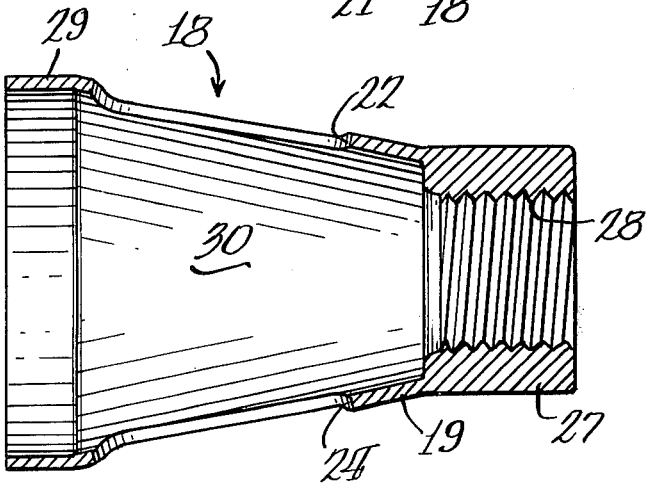
FIG. 4 is a diametric section thereof taken substantially along the line 4—4 of FIG. 2.

As best seen in FIGS. 2, 3 and 4, the diffuser 18 is defined by a frustoconical wall 19 which widens from a narrow outer end 20 to a wide inner end 21.

Wall 19 may be provided with at least one longitudinally extending slot 22, i.e. elongated in the direction of the axis 23 of the wall 19. In the illustrated embodiment, a pair of such slots 22 and 24 is provided in diametrically opposite portions of the wall 19, as shown in FIGS. 2 and 4.

Each of the slots may widen inwardly and may be defined by a rounded outer end 25 and a rounded inner end 26. As shown in FIG. 3, each slot may extend a major portion of the length of the frustoconical wall.

At its outer end 20, the wall 19 may be provided with a connecting portion 27 which may define an internal thread 28 adapted to have threaded connection to the connector 16 whereby the diffuser 18 projects into the lower portion of the tank, as shown in FIG. 1.

At its outer end 21, the wall 19 may be provided with an annular inward extension 29 comprising a tubular, right circularly cylindrical flange.

In the illustrated embodiment, the diffuser comprises a one-piece metal element which may be suitably formed as by casting and machining. The angularity of the frustoconical wall may be relatively small, and in the illustrated embodiment, the wall widens inwardly at an angle of approximately 10° to 15° to the axis 23 with the length of the wall being preselected so that the wide end 21 has a cross-sectional area at least 50 percent larger than the narrow end 20 thereof.

In the illustrated embodiment, flange 29 has a length of approximately 20 to 25 percent of the axial length of the frustoconical wall 19.

The connecting portion 27 may have a wall thickness substantially greater than that of the wall 19 and flange 29 to provide an improved positive connection of the diffuser to the flow passage connector 16.

Diffuser 18 effectively decelerates the returning liquid flow within the tank 11 so as to effectively minimize turbulent aeration of the liquid body 12 therein. Thus, where the circulation system comprises a hydraulic system, foaming of the hydraulic oil is effectively minimized, thereby providing improved performance and long life of the system components. Further, the elimination of foam and air in the hydraulic liquid provides an improved efficiency and component life in the operation of the pump 13 and other system components.

As will be obvious to those skilled in the art, the frustoconical wall 19 provides a gradual increase in the cross-sectional area of the returning liquid stream so as to effectively dissipate the kinetic energy of the returning liquid with minimized turbulence. By eliminating all obstructions within the space 30 defined by the wall portion 19 and flange 29, an improved nonturbulent reduction in the velocity and kinetic energy of the returning liquid is effected within the diffuser.

The provision of slot means in the wall 19 effects further improved nonturbulent deceleration of the returning liquid. Thus, the diffuser of the present invention has been found to develop a reduction in fluid velocity of at least 8 to 1 while concurrently eliminating back pressure within the hydraulic system.

Figure 5:
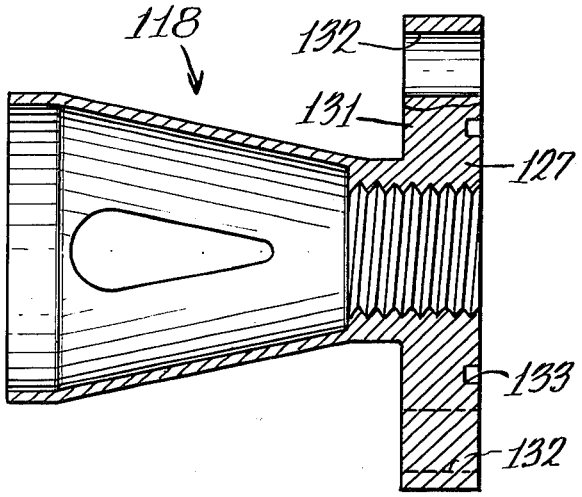
FIG. 5 is a diametric section of another form of diffuser embodying the invention utilizing a flanged mounting portion.
Figure 6:
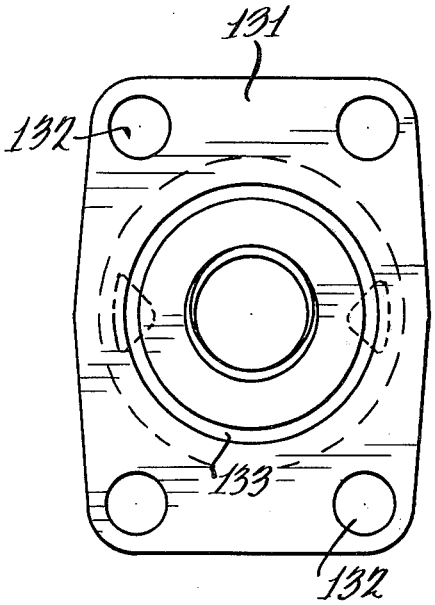
FIG. 6 is an end elevation thereof.

Referring now to FIGS. 5 and 6, a modified form of diffuser generally designated 118 is shown to comprise a diffuser generally similar to diffuser 18 but having a generally rectangular flange 131 extending transversely outwardly from the connecting portion 127.

The flange may be provided with suitable bolt holes 132 for extension of suitable mounting bolts (not shown) therethrough in securing the diffuser to the tank wall 11.

As further shown in FIGS. 5 and 6, the flange may be provided with an annular groove 133 for receiving a suitable O-ring or the like and sealingly mounting the diffuser to the tank wall.

Figure 7:
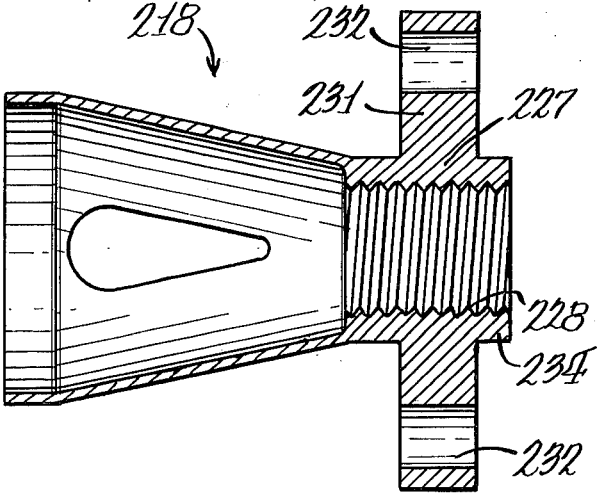
FIG. 7 is a diametric section of still another form of diffuser embodying the invention utilizing a different form of flanged mounting portion.
Figure 8:
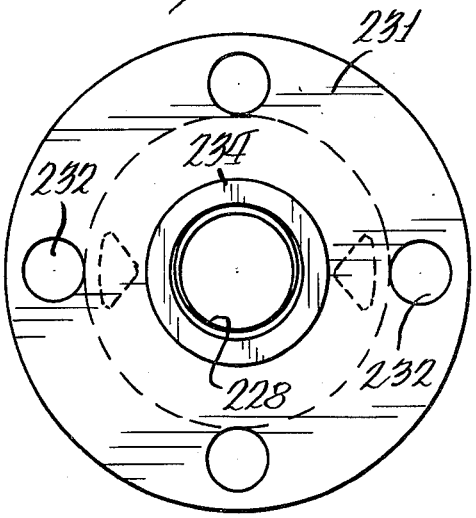
FIG. 8 is an end elevation thereof.

Referring now more specifically to FIGS. 7 and 8, a further modified form of diffuser generally designated 218 is shown to comprise a diffuser generally similar to diffuser 118 but having a circular flange 231 in lieu of the generally rectangular flange of diffuser 118.

The flange may be provided with a symmetrical array of mounting bolt holes 232 which, in the illustrated embodiment, are spaced apart 90° concentrically of the axis of the diffuser.

As further shown in FIG. 7, the connecting portion 227 further defines a rearward extending cylindrical boss 234 through which the threaded bore 228 opens.

Thus, the boss 234 may extend through a suitable opening (not shown) in the tank wall with the flange 231 being bolted directly to the tank wall by suitable bolts (not shown) extended through the bolt holes 232.

Except as discussed specifically above, the diffusers 118 and 218 are similar to and function similarly to diffuser 18. In each of the diffusers, similar elements or portions thereof are identified by similar reference numerals but 100 different.

The foregoing disclosure of specific embodiments is illustrative of the broad inventive concepts comprehended by the invention.

I claim:

1. In a liquid circulation system having a tank for holding a body of liquid, means for circulating liquid from the tank and through a return flow passage back into the tank, the improvement comprising a diffuser in said tank connected to said return flow passage for diffused delivery of the returning liquid into the body of liquid in the tank, said diffuser being defined by a frustoconical wall having a connecting means at its narrow outer end adapted to have fluid flow communication with the return flow passage for delivering the returning liquid into the frustoconical interior space defined by said wall, said wall being provided with at least one slot elongated in a direction parallel to the axis of the wall and extending a major portion of the length of said wall, the slot widening toward the wide end of the wall to have its widest portion disposed adjacent said wide end of the wall, said interior space of the wall being free of obstructions to permit the returning liquid to flow through said space into the body of liquid in the tank with the cross-sectional area of the returning liquid stream gradually increasing within said space to effectively minimize turbulent aeration of the liquid.

2. The liquid system structure of claim 1 wherein said diffuser is mounted in a bottom portion of the tank.

3. The liquid system structure of claim 1 wherein said diffuser includes a tubular flange extending coaxially inwardly from the inner wide end of the frustoconical wall.

4. The liquid system structure of claim 1 wherein a pair of said slots is provided in said wall at diametrically opposite portions thereof.

5. The liquid system structure of claim 1 wherein said system comprises a hydraulic system wherein said liquid comprises hydraulic oil.

6. The liquid system structure of claim 1 wherein said tank is provided with a threaded connector communicating with said return flow passage and said diffuser connecting means defines threaded means connected to said threaded connector.

7. The liquid system structure of claim 1 wherein the wide end of said frustoconical wall space is at least 50 percent larger than the narrow end thereof and the slot is disposed closer to the wide end than to the narrow end.

8. In a liquid circulation system having a tank for holding a body of liquid, means for circulating liquid from the tank and through a return flow passage back into the tank, the improvement comprising a diffuser in said tank connected to said return flow passage for diffused delivery of the returning liquid into the body of liquid in the tank, said diffuser being defined by a frustoconical wall having a connecting means at its narrow outer end adapted to have fluid flow communication with the return flow passage for delivering the returning liquid into the frustoconical interior space defined by said wall, said wall being provided with at least one slot elongated in a direction parallel to the axis of the wall and extending a major portion of the length of said wall, the slot widening toward the wide end of the wall to have its widest portion disposed adjacent said wide end of the wall and defining rounded inner and outer ends, said interior space of the wall being free of obstructions to permit the returning liquid to flow through said space into the body of liquid in the tank with the cross-sectional area of the returning liquid stream gradually increasing within said space to effectively minimize turbulent aeration of the liquid.

9. The liquid system structure of claim 8 wherein said frustoconical wall widens inwardly at an angle of approximately 10° to 15° to the axis of said wall.

10. The liquid system structure of claim 8 wherein said diffuser includes a tubular flange extending coaxially inwardly from the inner wide end of the frustoconical wall, said flange having a length approximately 20 to 25 percent of the axial length of said frustoconical wall.

11. The liquid system structure of claim 8 wherein said diffuser is provided with a securing flange extending transversely outwardly from said connecting means at the outer end of the frustoconical wall, said securing flange being provided with suitable bolt holes for use in connecting the diffuser to the tank.

12. The liquid system structure of claim 11 wherein said securing flange is provided with an annular outwardly opening groove for receiving a suitable sealing means in sealingly mounting the diffuser to the tank.

13. The liquid system structure of claim 11 wherein the connecting means defines a cylindrical boss extending outwardly from the outer plane of the flange.

* * * * *